United States Patent [19]

Barry et al.

[11] Patent Number: 5,052,130

[45] Date of Patent: Oct. 1, 1991

[54] SPRING PLATE SHOE

[75] Inventors: Daniel T. Barry, Ann Arbor; Ray Fredericksen; Robert W. Soutas-Little, both of Okemos; Ruk R. Peterson, Grand Rapids, all of Mich.

[73] Assignee: Wolverine World Wide, Inc., Rockford, Mich.

[21] Appl. No.: 510,671

[22] Filed: Apr. 18, 1990

Related U.S. Application Data

[63] Continuation-in-part of Ser. No. 131,309, Dec. 8, 1987, which is a continuation-in-part of Ser. No. 942,245, Dec. 15, 1986, abandoned.

[51] Int. Cl.[5] ..... A43B 13/12; A43B 13/24

[52] U.S. Cl. ..... 36/107; 36/114; 36/30 R

[58] Field of Search ..... 36/114, 107, 108, 28, 36/30 R, 27, 76 C, 31, 102; 128/581, 595, 614, 619, 622

[56] References Cited

U.S. PATENT DOCUMENTS

| | | | |
|---|---|---|---|
| 75,900 | 3/1868 | Hale . | |
| 180,819 | 8/1876 | Ames . | |
| 634,588 | 10/1899 | Roche . | |
| 872,615 | 12/1907 | Eastman . | |
| 898,951 | 9/1908 | Zooboavch . | |
| 1,751,990 | 3/1930 | Gilkerson | 36/28 |
| 1,907,136 | 5/1933 | Weitsen . | |
| 2,034,243 | 3/1936 | Maxwell | 36/108 |
| 2,049,604 | 8/1936 | Cristallini | 36/108 |
| 2,185,993 | 1/1940 | Haskell | 12/142 |
| 2,330,398 | 9/1943 | Vass | 36/91 |
| 2,475,417 | 7/1949 | Wysowski | 128/80 |
| 3,039,207 | 6/1962 | Lincors | 36/58.5 |
| 3,414,988 | 12/1968 | Mattos | 36/91 |
| 3,835,558 | 9/1974 | Revill | 36/44 |
| 4,081,917 | 4/1978 | Bradley et al. | 36/76 |
| 4,231,169 | 11/1980 | Toyama et al. | 36/43 |
| 4,360,027 | 11/1982 | Friedlander et al. | 128/581 |
| 4,398,357 | 8/1983 | Batra | 36/31 |
| 4,404,757 | 9/1983 | Sweeny | 36/107 |
| 4,439,934 | 4/1984 | Brown | 36/44 |
| 4,454,662 | 6/1984 | Stubblefield | 36/88 |
| 4,463,505 | 8/1984 | Duclos | 36/30 |
| 4,481,726 | 11/1984 | Phillips | 36/30 A |
| 4,486,964 | 12/1984 | Rudy | 36/28 |
| 4,492,046 | 1/1985 | Kosova | 36/27 |
| 4,510,700 | 4/1985 | Brown | 36/28 |
| 4,520,581 | 6/1985 | Irwin | 128/622 |

(List continued on next page.)

FOREIGN PATENT DOCUMENTS

| | | | |
|---|---|---|---|
| 56011 | 11/1974 | Canada . | |
| A13126301 | 1/1983 | Fed. Rep. of Germany . | |
| 3318181 | 11/1984 | Fed. Rep. of Germany . | |
| 475731 | 11/1952 | Italy . | |
| 0170695 | 7/1982 | Netherlands | 36/91 |
| 90/01276 | 2/1990 | PCT Int'l Appl. | 36/30 R |
| 12550 | of 1907 | United Kingdom . | |

OTHER PUBLICATIONS

"the Spring in Your Step", by R. McNeill Alexander, *New Scientist*, Apr. 30, 1987.

"Shoes With Rebound Effect Soles", p. 37, American Journal of Physiological Medicine, Feb. 1987.

*Primary Examiner*—Steven N. Meyers

*Attorney, Agent, or Firm*—Price, Heneveld, Cooper, DeWitt & Litton

[57] ABSTRACT

An athletic shoe with a spring plate in combination with a viscoelastic midsole, such spring plate extending substantially the length of the midsole from the medial side of the heel through the arch where the spring plate is curvilinear and on the exterior of the shoe, through the metatarsal head area and beneath the toes. The spring plate is of multiple layers, each of parallel carbon fibers embedded in polymer, the fibers being at acute angles in successive layers, in symmetry. The stiffness of the plate is anisotropic, being greater longitudinally than laterally. The thickness of the plate forward of the metatarsal break line is half that of the plate rearwardly of the break line.

10 Claims, 4 Drawing Sheets

U.S. PATENT DOCUMENTS

| | | | |
|---|---|---|---|
| 4,534,124 | 8/1985 | Schnell | 36/114 |
| 4,542,598 | 9/1985 | Misevich et al. | 36/107 |
| 4,561,195 | 12/1985 | Onoda et al. | 36/30 R |
| 4,597,195 | 7/1986 | Dananberg | 36/28 |
| 4,598,486 | 7/1986 | Olivieri | 36/96 |
| 4,598,487 | 7/1986 | Misevich | 36/114 |
| 4,612,713 | 9/1986 | Brown | 36/44 |
| 4,614,046 | 9/1986 | Dassler | 36/30 R |
| 4,615,126 | 10/1986 | Mathews | 36/25 |
| 4,628,621 | 12/1986 | Brown | 36/44 |
| 4,651,445 | 3/1987 | Hannibal | 36/76 C |
| 4,766,679 | 8/1988 | Bender | 36/30 R |
| 4,774,954 | 10/1988 | Ibrahim | 36/44 |
| 4,785,557 | 11/1988 | Kelley et al. | 36/30 R |
| 4,815,221 | 3/1989 | Diaz | 36/27 |
| 4,854,057 | 8/1989 | Misevich et al. | 36/114 |
| 4,858,338 | 8/1989 | Schmid | 36/44 |
| 4,878,300 | 11/1989 | Bogaty | 36/30 R |
| 4,922,631 | 5/1990 | Anderie | 36/114 |

SPRING PLATE SHOE

RELATED APPLICATION

This application is a continuation-in-part application of pending parent application entitled Shoe With Spring-Like Sole Member, Ser. No. 131,309, filed Dec. 8, 1987, by one of the inventors herein, which parent application is a continuation-in-part of application Ser. No. 942,245, filed Dec. 15, 1986, and entitled Shoe With Spring-Like Sole Member now abandoned.

BACKGROUND OF THE INVENTION

This invention relates generally to footwear, and more particularly to a shoe having incorporated therein a special leaf spring-like member which is formed of a fiber reinforced polymeric material for absorbing and releasing energy during each step.

A variety of approaches have been taken toward relieving the stresses which are imposed on a human foot during walking and running. Known approaches utilize resilient, spring-like arrangements which absorb and release energy during each step of walking or running. The known arrangements store and release energy via resilient members. Many of these are arranged to operate in a direction which is orthogonal to the sole of the shoe. Some employ strips, or plates built into the shoe sole, or an orthotic in the shoe. Examples of prior constructions are shown in U.S. Pat. No. 3,039,207 and 4,231,169, British Patent Specification 56,011/73 and German Patent Disclosure 31 26301, with orthotics being set forth in U.S. Pat. No. 4,360,027, 4,612,713 and 4,628,621.

In a recent U.S. Pat. No. 4,858,338 is described a particular type of insert wherein a strip extends from the outer (lateral) heel area to the large toe area where it forms a rocker bottom to cradle the first metatarsal head. A second strip extends from the four small toes to the arch area at the opposite lateral border of the sole.

SUMMARY OF THE INVENTION

It is an object of this invention to provide a simple and economical shoe having associated therewith an arrangement for storing and releasing energy in a manner beneficial to a runner, and which stores and releases energy in conformance with the natural foot movement of a runner.

It is a further object of this invention to provide a running shoe having an arrangement wherein energy stored during each running step is released in a direction of travel of the runner, employing a special resilient leaf spring-like member for incorporation in the shoe, the spring-like member having a lifetime of many flexures.

It is an additional object of this invention to provide a resilient spring-like member which cooperates with a shoe so as to have a flexure characteristic which is easily adaptable for a particular runner, and to have a resilience characteristic which is easily adaptable to complement the resilient characteristic of a running surface.

It is a still further object of this invention to provide a resilient spring-like member which is configured to achieve a nonlinear flexure characteristic, and yet which can easily be incorporated into the structure of a running shoe.

The foregoing and other objects are achieved by this invention which provides a shoe having a leaf spring-like flexible resilient member arranged in the sole of the shoe. In accordance with the invention, the flexible resilient member has a predetermined flexure characteristic and is arranged to flex with the sole of the shoe in the region of the ball of the foot of the human wearer during each step. The shoe accommodates the natural movement of the foot, and cooperates uniquely with the natural spring action of the foot biomechanism. The material, a fiber-reinforced polymeric material, stores and releases energy in response to such flexure during each step. The spring plate extends from beneath the medial portion of the heel region, through the arch region, up to and beneath the toe region, extending substantially the full length of the midsole. The spring plate is tapered down in the rear to extend primarily beneath the medial portion of the heel region, and not significantly beneath the lateral portion of the heel region, leaving the lateral heel area with the lateral outsole portion directly in engagement with the midsole. This results in enhanced rear foot stability while maintaining shock absorption of the lateral heel portion of the midsole as explained hereinafter. The spring plate forms a special integral spring arch, preferably exterior of the shoe, and beneath the arch of the foot. It has a greater thickness rearwardly from substantially the metatarsal head region, formed of more layers, and less thickness forwardly of the metatarsal head region, formed of less layers, these being joined together in an integral interface. This integral interface is at an acute angle relative to the center longitudinal axis of the shoe, sloping rearwardly from the medial side of the shoe to the lateral side of the shoe, at an angle of about 60° plus or minus about 10°. The spring plate preferably has elongated parallel fibers in each layer, bonded within a polymer, and arranged at an acute angle relative to the longitudinal axis of the shoe. The fibers in the layers are oriented in composite symmetry relative to this axis. The spring plate has anisotropic stiffness, with greater stiffness longitudinally than laterally.

In the preferred embodiment of the invention, the material which forms the flexible resilient member is of carbon fiber-reinforced epoxy in a plurality of even number layers.

Each layer of fiber-reinforced polymeric material has a flexure characteristic which is directional resulting from the orientation of the parallel reinforcing fibers within the material. Typically, such material can withstand greater forces, such as bending forces, in the direction of the fiber orientation, than transverse thereto. The various layers of fiber-reinforced material which form the flexible resilient member may each have a directional aspect to the respective flexure characteristic. Such layers are arranged so that the directions of fiber orientation are at predetermined respective angles to one another. In this manner, the longitudinal and transverse flexure characteristics of the flexible resilient member can be tailored for a specific activity in which the human wearer is expected to engage. The flexible resilient member may be curved in a manner which conforms to the sole of the shoe. For example, the flexible resilient member may be curved upward in the region of the front of the shoe, as well as having the special curvilinear spring arch on the bottom of the shoe.

In accordance with a further aspect of the invention, the flexible resilient member cooperates with the outer sole and the midsole of the shoe to achieve a tuned response. Thus, the flexible resilient member functions as a spring, while the outer sole and particularly the heel portion of the midsole operate as a damping medium. The midsole and inner sole can also function as damping media. A damping medium may assist in reducing one or more oscillation modes of the shock wave produced in a runner's leg by the impact at foot strike and also may assist in tuning the system for the particular running characteristics of the wearer. Similarly, cushioning material in the heel region can serve to dampen oscillations.

Another important object of the invention is to provide a cooperative action of the spring plate with a viscous heel midsole so that the combination effects impact cushion stability during foot roll, and energy return during toeoff. The viscous midsole can be of a foam polymer such as ethylene vinyl acetate, or preferably the dynamic viscous fluid arrangement set forth in a copending application identified hereinafter.

The novel construction is considered particularly effective in a performance running shoe.

DETAILED DESCRIPTION OF THE PREFERRED EMBODIMENT

Figure 1:
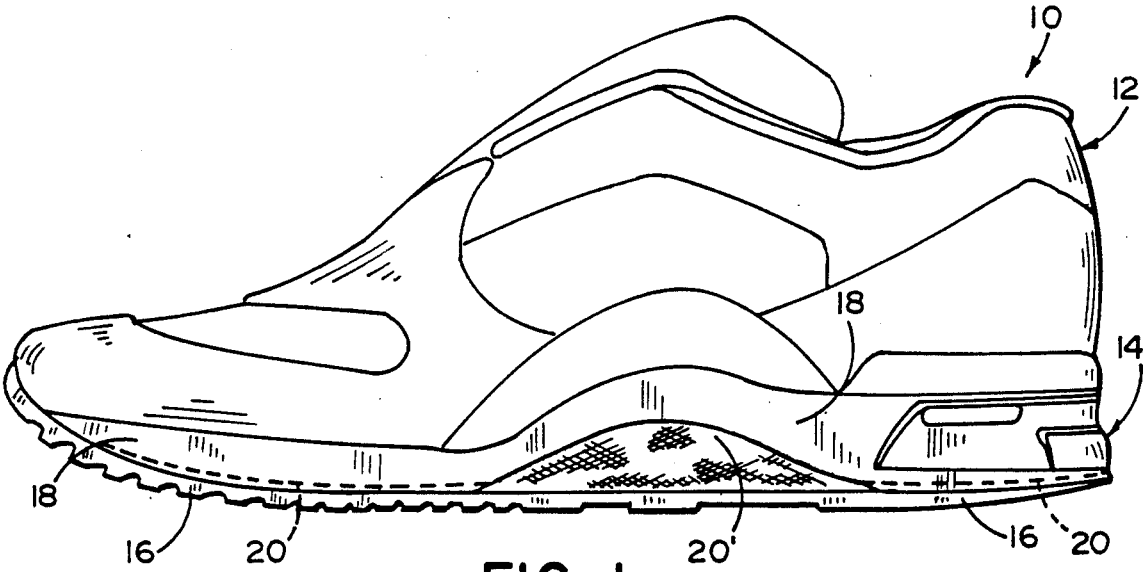
FIG. 1 is a side elevational view of the medial side of a shoe constructed in accordance with the invention.
Figure 2:
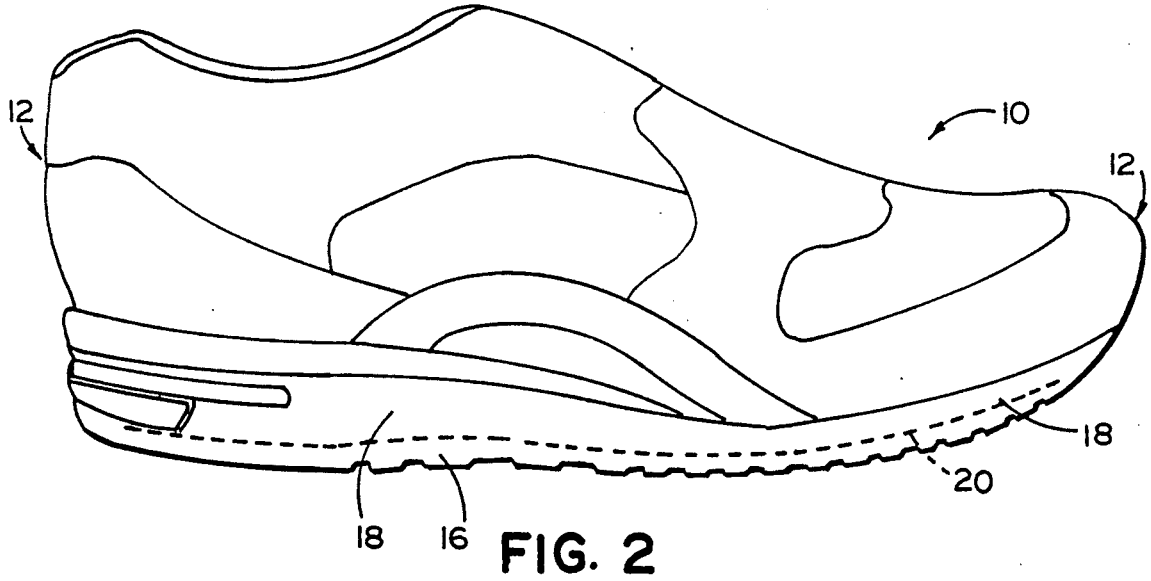
FIG. 2 is a side elevational view of the lateral side of the shoe in FIG. 1.

To fully appreciate the present invention, it is helpful to realize the nature and function of the human foot, and the manner in which the invention functions synergistically therewith.

During running gait a runner will contact the ground with a vertical ground reaction force of approximately 2.5 to 3.0 times his/her body weight. Examination of the vertical force plot (FIGS. 6 and 7) reveals two maximum load peaks. The first peak occurs very rapidly and is associated with initial foot impact. The second, more slowly rising peak is associated with foot propulsion as the heel is lifted off the ground and the load is shifted to the metatarsal heads of the forefoot. Also during the contact phase, a runner will exhibit a braking and propulsive ground reaction force that will coincide with the vertical force. The third ground reaction force component is a medial-lateral force associated with the internal and external rotation of the foot and leg. These three vector force components are illustrated in FIG. 7.

A runner typically contacts the ground heel first, usually on the lateral portion of the heel, with the foot in a rigid supinated position. Immediately after contact, the foot switches from a rigid structure to a mobile one, as it pronates to attenuate the ground reaction forces associated with heel strike. At maximum midstance pronation, the foot then resupinates and the arch of the foot is returned to a rigid structure to allow for stable propulsion at toeoff. The motion sequence of pronation and supination of the foot is the body's natural mechanism for attenuating impact shock and storing potential energy for propulsion.

The function of the arch of the foot has in the past been likened to a spring. The arch "coils down" as the foot flattens during pronation to attenuate impact shock. At the same time it stores potential energy and then "springs back" as the foot resupinates during the propulsion phase. The spring-like mechanism of the foot is due to the truss-like structure of the arch of the foot, and the elastic characteristics of human connective tissue; i.e., muscle, tendon, bone and ligament. Human connective tissues store and release energy as they stretch and contract, something like rubber bands.

Prior athletic shoe designs on the market have primarily focused on attenuating the impact associated with heel strike while running. These designs typically employ closed cell foams such as polyurethane, ethylene vinyl acetate, or other viscoelastic materials in the midsole of the shoe. More recently, research studies have suggested that athletic shoe midsole designs may be too viscous such that overpronation and/or bottoming out could occur, conceivably contributing to overuse injuries associated with running.

The propulsion plate of the present invention is an elastic unit which is incorporated into a running shoe midsole to function synergistically with a midsole viscous medium. The unique design of the propulsion plate allows for controlled metering of cushioning and rebound, given a runner's body weight and running speed.

The plate containing design incorporates in one integral unit a rearfoot stability component, impact cushioning, an external arch support, and a forefoot propulsion component. The special arch support of the design is a more efficient mechanism in dissipating and storing potential energy than a conventional internal arch support. Conventional arch supports interfere with the ability of the foot to flatten out and spring back. The external arch support of the present invention increases the efficiency of the natural spring mechanism of the foot.

The propulsion plate consists of multiple layers of polymer and carbon fibers, placed in specific alignment to each other. Each layer consists of unidirectional, i.e., parallel, carbon fibers preferably preimpregnated in a resin, preferably an epoxy resin. By changing the alignment of fibers in the adjacent layers relative to each other, the stiffness and bending characteristics of the plate can be adjusted.

The length of the plate spans substantially the entire length of the midsole. The plate extends from the medial heel zone, forwardly through the arch region and sufficient to underlie the metatarsals and toes. The plate terminates a small amount from the front and heel ends of the midsole to prevent the rather sharp edges of the plate from cutting anything or anyone, and to allow adequate adhesive area between the overlying midsole and the underlying outsole in these areas. The configurated arch of the plate preferably has its underside exposed to achieve its external function features. This is done by providing an opening in the outsole at the medial portion of the arch. Conceivably this opening could be filled as with a filler if it is desired that the plate not be visible. The width of the rearfoot stability component is narrowed by being tapered so as to be substantially more narrow at the rearfoot region than the midsole, sloping to underlie the medial area but not a significant portion of the lateral area of the heel. This minimizes torsional stiffness. If the plate extended beneath the outside, i.e., lateral area of the heel, the additional torsional stiffness would increase the rate and degree of pronation, increasing the potential for injury. The present structure effects rearfoot stability with effective impact absorption at heel strike.

Human connective tissue is not only sensitive to the magnitude of the force applied, but also to the rate in which it is applied. The rearfoot stability component and the external arch support of the plate function together to provide a smooth transition from heel strike to midstance. The velocity and degree of pronation are controlled while at the same time shock is attenuated and potential energy is stored by the external arch support. As the heel is lifted off the ground, energy is released from the external arch support and assists in bending the forefoot propulsion plate while the load is transferred to the metatarsal heads. Throughout the toeoff phase the energy stored in the forefoot plate is released to provide a fluid propulsion into the next stride. It is important to allow sufficient bending and recoil during the loading and propulsion phase of gait.

In the heel tail portion, the arch portion and up to the metatarsal break line, the thickness and stiffness are greater than forwardly of the break line. Preferably, four layers of embedded carbon fiber are placed at 60° alignment relative to each other in the rear region. The composite of layers is symmetrical relative to the fibers. That is, if one layer has its fibers at an angle of 30° to the longitudinal axis at one side of the axis, another layer will be at an angle of 30° to the axis on the other side. The result is symmetry. This fiber alignment and stiffness is preferred in order to efficiently attenuate heel shock and control the rapid velocity of rearfoot pronation. The specific angle of the fibers may be varied from 60° to tune the shoe to particular activities and/or persons. Also, the number of layers and consequent stiffness can be varied for tuning purposes. The metatarsal break line (B) of the foot (FIG. 4) is typically at an average angle of 60° relative to the longitudinal axis of the shoe. Forwardly of the metatarsal heads the propulsion plate tapers to two layers to facilitate forefoot flexibility. The four layer portion and two layer portion have an integral interface juncture therebetween. The exact location of the interface juncture can be varied a small amount. For example, if a person has sensitive metatarsal heads it may be desirable to have the juncture a small amount behind the break line, and even to incorporate a metatarsal bar. Because the propulsion plate design utilizes deflection of the external arch, as well as bending of the plate, to achieve its elastic qualities, some tempering is needed in this area to avoid violent uncoiling of the plate which may be injurious. This tempering is effected by the change to less thickness, i.e., two layers in the forefoot plate compared to four layers in the other portions, and by the symmetrical arrangement of the parallel fibers at angles to each other in successive layers.

This invention takes advantage of the fact that as a person runs, the arch of the foot plays a key role in attenuating impact shock and in storing potential energy to be used for propulsion. The propulsion plate works synergistically with the natural spring mechanism of the foot and the function of the viscoelastic midsole to provide more efficient running biomechanics.

Referring now specifically to the drawings, an illustrative embodiment incorporating the invention is disclosed in the form of an athletic shoe 10 having an upper 12 secured to a sole assembly 14.

Figure 3:
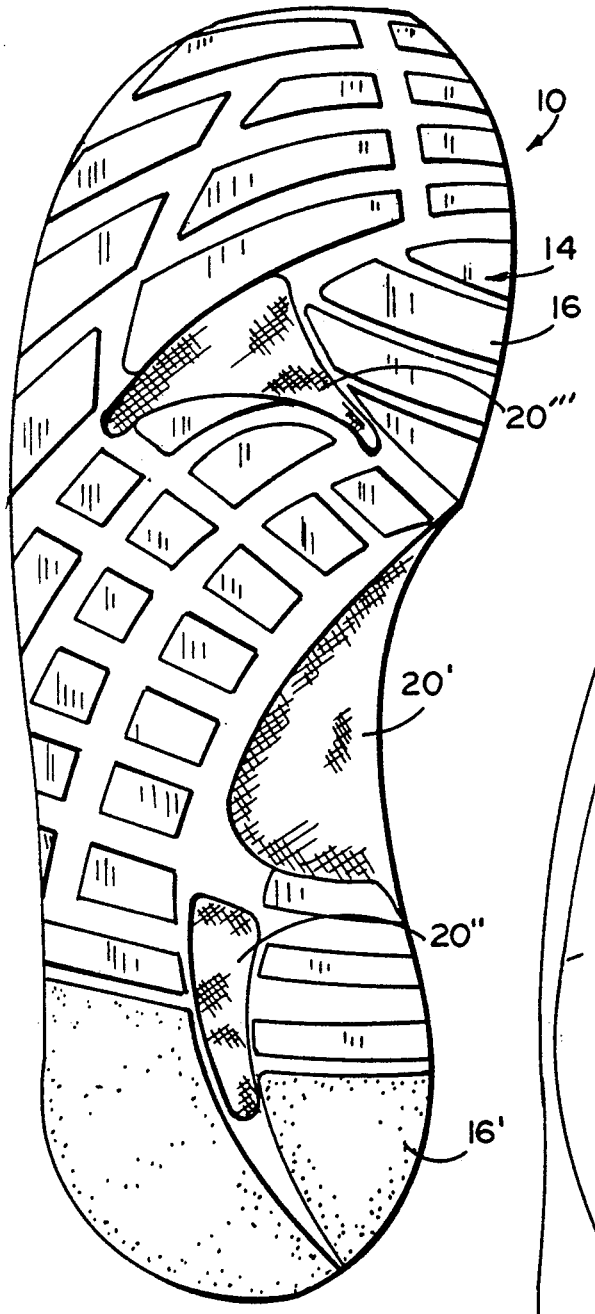
FIG. 3 is a bottom view of a shoe embodying the invention.

The upper may be of a variety of configurations and/or constructions such as those well known in the art. The upper is secured to the sole assembly by stitching and/or adhesive, using any of a variety of well known techniques. The sole assembly comprises an outer sole 16, a midsole 18, a specially configurated spring plate 20 between the outer sole and midsole, the arch portion of this special plate being exposed, i.e., external of the shoe structure, as at 20'. The outsole 16 is specially configurated to have an opening at the medial arch region (FIG. 3), causing the curvilinear convex medial arch portion 20' of spring plate 20 to be exposed on the exterior of the shoe, yet offset upwardly from the main plane of the outer sole 16. Optionally, additional portions of the outsole may be skived out or lacking to cause the spring plate to be there exposed such as in the center of the heel at 20'' (FIG. 3) and in the center of the metatarsal zone as at 20'''. The outer sole is formed of conventional abrasion resistant material such as rubber, the heel part 16' of the outsole optionally being of a higher durometer material than the remainder of the outsole. FIG. 1 depicts the outsole extending up over the midsole and a portion of the upper at the toe to inhibit toe scuffing, in conventional fashion.

Midsole 18 is formed of a conventional viscous elastic material such as foamed ethylene vinyl acetate (EVA), polyurethane (PU), or other viscoelastic, polymeric, expanded, closed cell foam material. The heel area of the midsole can incorporate the dynamic viscous fluid structure disclosed in patent application Ser. No. 339,198, filed Apr. 14, 1989, entitled Fluid Dynamic Shoe, and incorporated herein by reference, in place of or in addition to the foam material Spring plate 20, bonded between the midsole and outsole, extends substantially the length of the midsole 18 (FIG. 4), terminating short at the front end and the rear end just sufficient amounts to prevent the edges of the plate from being exposed to thereby cut materials, things or persons, and to achieve effective bonding between the midsole and outsole in these regions. The midsole, spring plate and outsole are bonded to each other by any suitable adhesive such as those typically used in the shoe trade. The finished shoe may also include a conventional inner sole and sock liner (not shown).

The specific structure of the spring plate illustrated, as previously noted, is of multiple layers of elongated fibers, namely carbon fibers, (otherwise designated graphite fibers), embedded in polymer so as to be embodied by the polymer matrix, preferably of an epoxy resin. Each individual layer has the fibers therein extending in the same direction, i.e., to be parallel to each other, the fibers being laid side-by-side. The individual layers are bonded to each other. In the preferred embodiment, one layer is arranged relative to the adjacent layer to cause the fibers to be at an acute angle to each other of about 60°, plus or minus about 10°, i.e., about 30° relative to the longitudinal axis of the shoe sole assembly. There is an even number of layers so that the total grouping of fibers constitutes a symmetrical arrangement and flexing action. The fibers in this angular arrangement create an anisotropic stiffness, with greater stiffness longitudinally than laterally of the sole. The spring plate has flexibility with inherent memory to return it to its original molded configuration. The optimum arrangement is four layers in the portion of the plate in the heel region, the arch region and up to about the metatarsal break line, merging integrally into two layers forwardly of the metatarsal break line and under the toes. The mergence of the four layer portion with the two layer portion creates an integral juncture at the metatarsal break line with an angle of approximately 60° to the longitudinal axis of the sole, from the medial side rearwardly to the lateral side.

Figure 4:
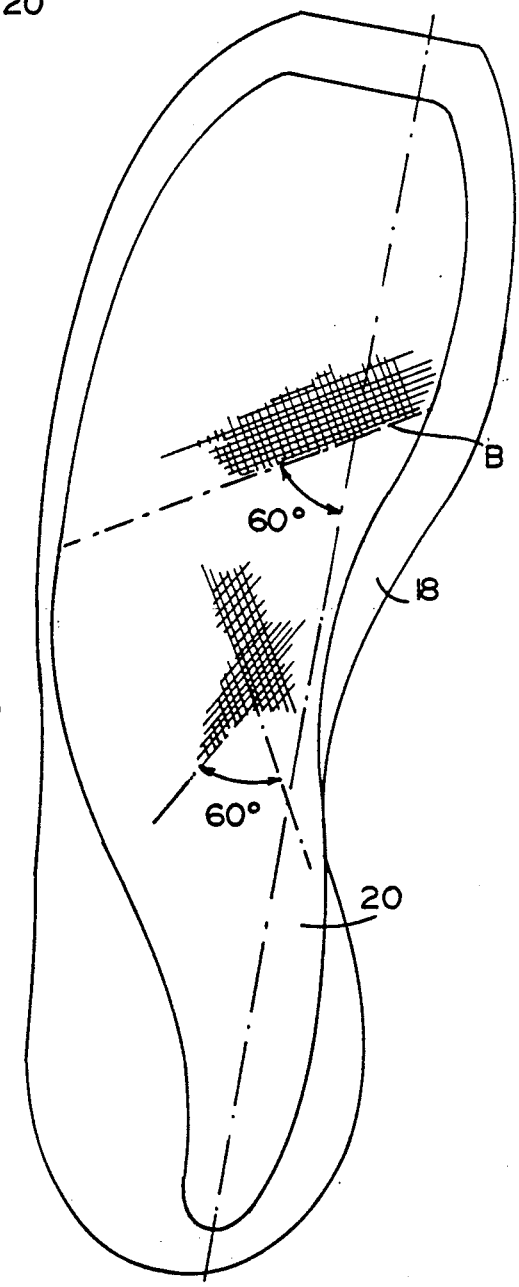
FIG. 4 is a plan view of the spring plate insert outline relative to the midsole outline.
Figure 5:
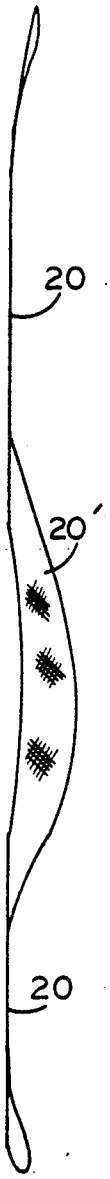
FIG. 5 is a side elevational view of the insert in FIG. 4.

The configuration of the spring plate is depicted in FIGS. 4 and 5, with FIG. 4 showing the spring plate relative to the outline of the midsole. It will be noted that the spring plate tapers to include a relief at the lateral portion of the heel but extends substantially beneath the medial side of the heel. Thus, at heel strike, typically on the outer, i.e., lateral, portion of the heel, the runner has the benefit of the full cushioning and shock absorption effect of the viscous midsole, but immediately thereafter acquires the stability and control characteristics as well as the energy return of the spring plate as the foot moves through the gait cycle.

Figure 6:
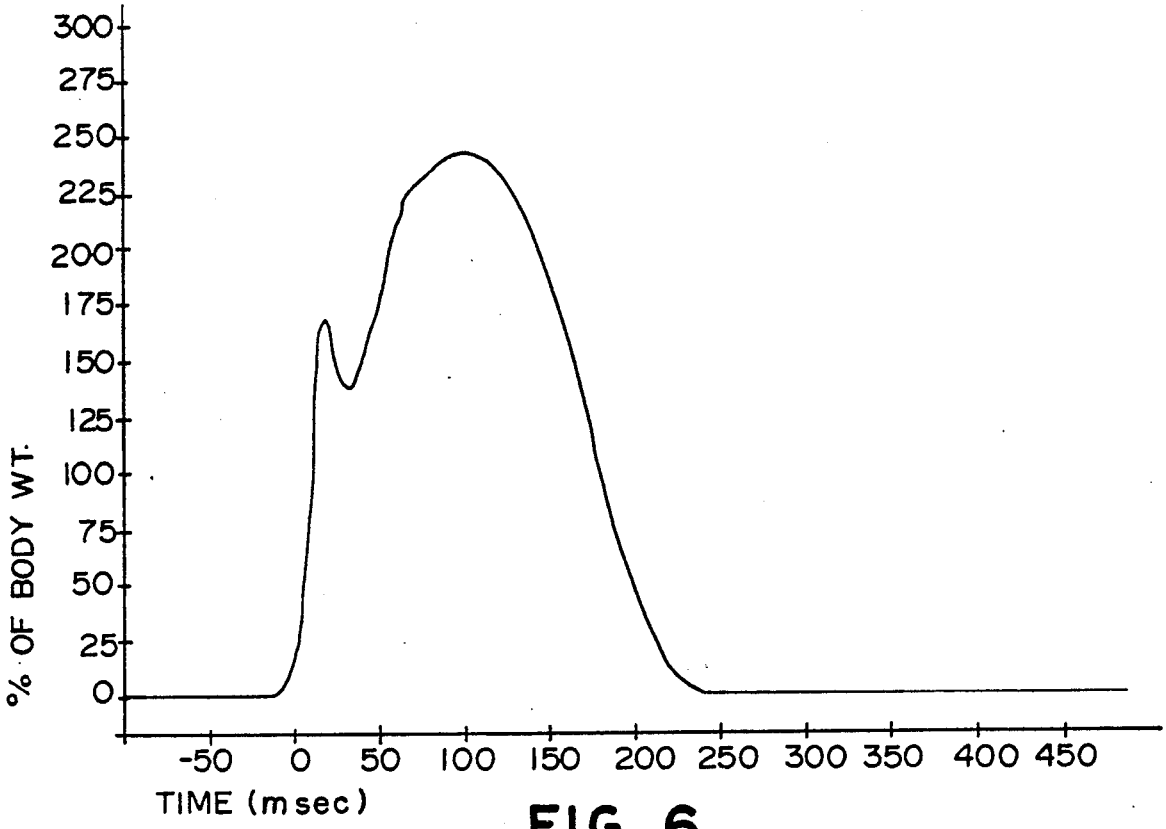
FIG. 6 is a force plate graph or plot depicting a typical single vertical ground reaction force.
Figure 7:
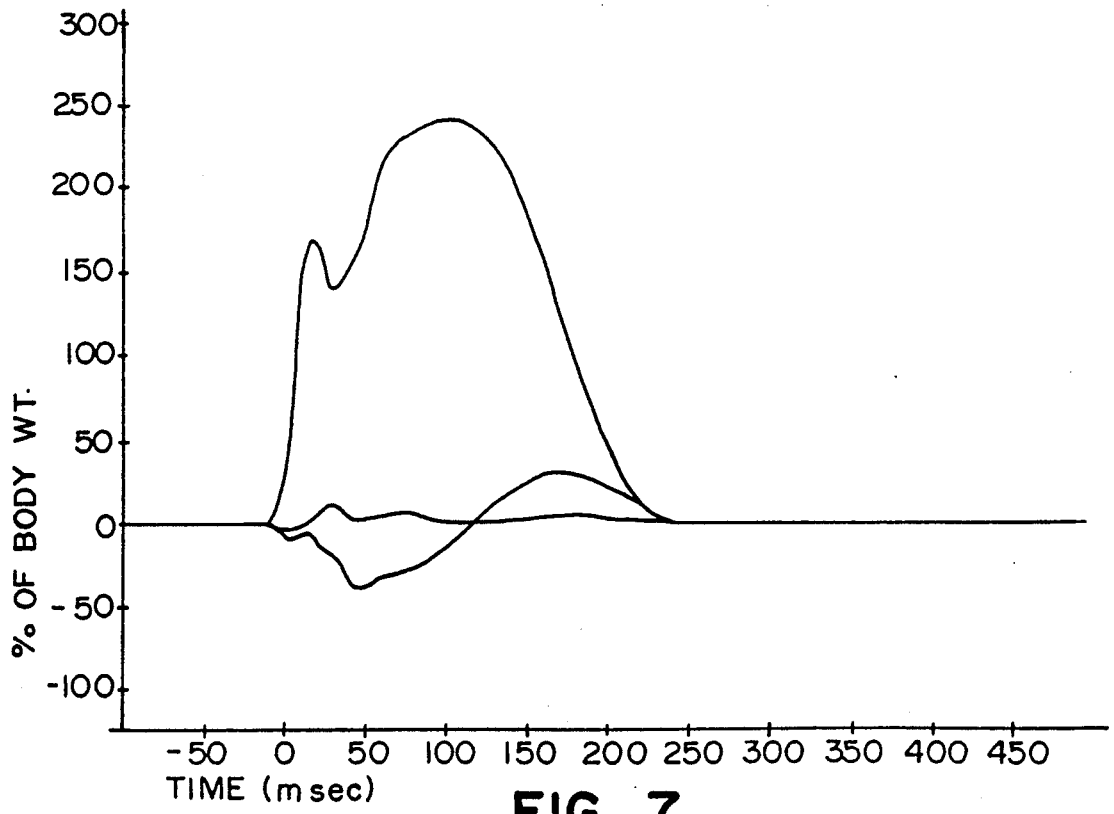
FIG. 7 is a force plate graph or plot depicting the three typical ground reaction forces, namely vertical ground reaction force, braking and propulsive ground reaction force, and medial-lateral ground reaction force, superimposed on each other.

To further understand the function of the invention, reference is made also to the graphs or plots shown in FIGS. 6–9. FIGS. 6 and 7 comprise plots showing typical ground reaction forces, as measured by a conventional force plate, of a running person. At time zero when the heel begins to strike the ground, there is an immediate sharp increase in the ground reaction force shown by the initial spike. After the initial heel strike, the ground reaction force declines somewhat as the foot rapidly pronates, and then increases substantially as the foot begins to supinate until a maximum force of about 250 percent times the body weight occurs. Thereafter, while the foot ultimately moves into toeoff, the ground reaction force decreases until the toes lift from the ground, at which point the force is zero. FIG. 7 depicts the three individual ground reaction forces, i.e., the vertical ground reaction force, the braking and propulsive ground reaction force, and the lateral-medial ground reaction force superimposed on each other. More specifically, the more dominant curve is the vertical force, the generally sinusoidal curve is the braking and propulsive ground reaction force, and the smallest curvature is the lateral-medial ground reaction force.

Figure 9:
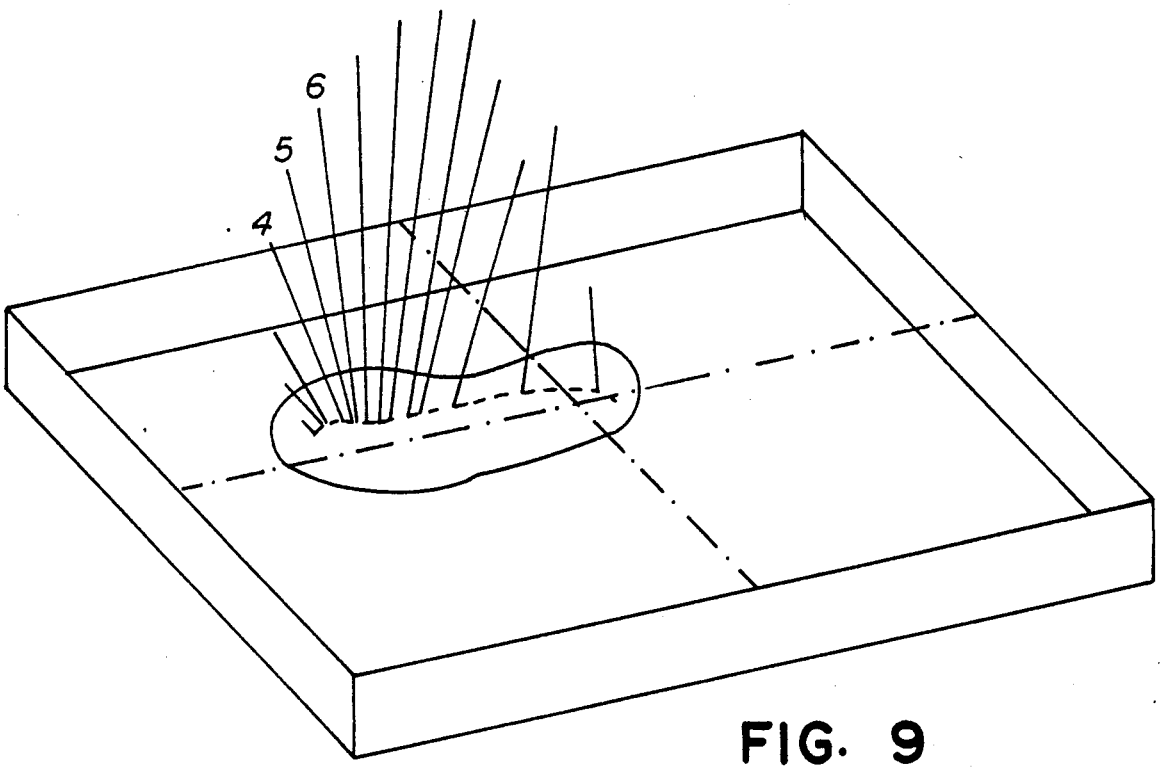
FIG. 9 is a center of pressure plot which is a resultant of the ground reaction forces of a shoe modified to incorporate the present invention.
Figure 8:
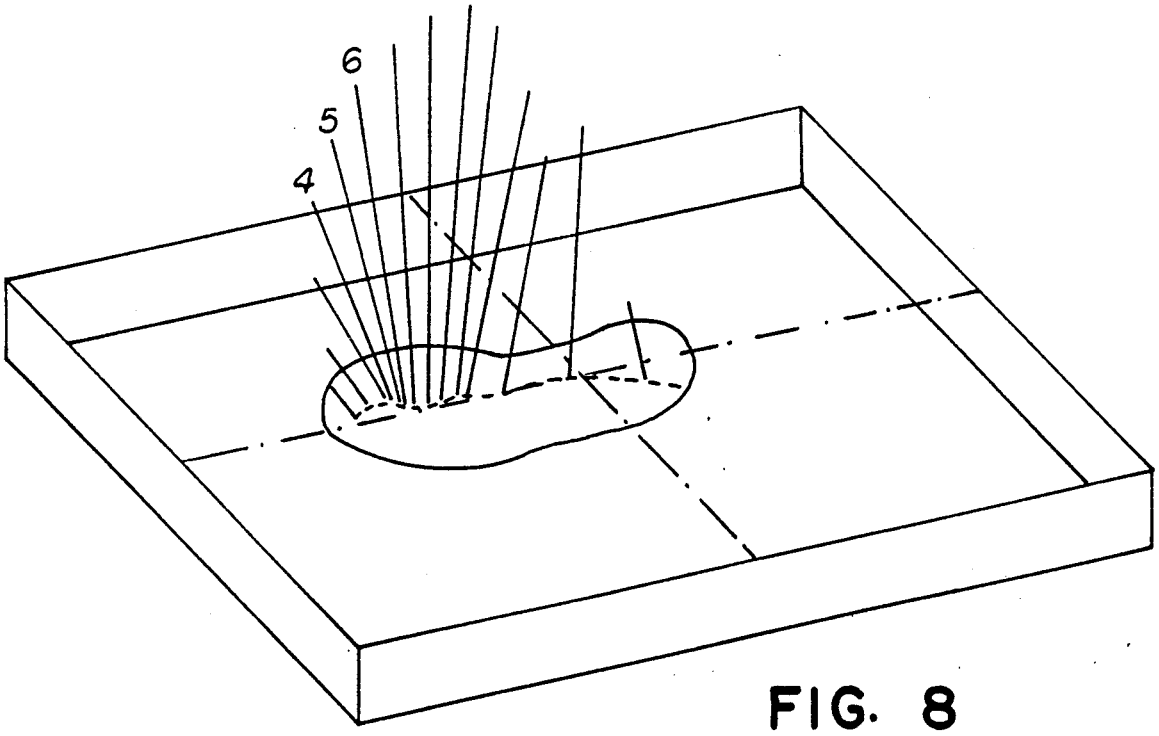
FIG. 8 is a center of pressure plot which is a resultant of the three ground reaction forces in FIG. 7 of a conventional athletic shoe.

In FIGS. 8 and 9 are two dimensional computer printouts of center of pressure patterns showing the orientation magnitude and position of ground reaction forces entering the body and effecting a center of mass of the body. The plot in FIG. 8 is that of a neutral conventional EVA midsole running shoe, while FIG. 9 depicts a center of pressure plot of ground reaction forces for the shoe incorporating the EVA midsole in combination with the spring plate according to the present invention. Ground reaction force data was obtained for left foot contact as the runner ran across the force plate. The center of pressure is calculated as the resultant force of the three directional ground reaction forces, i.e., vertical, fore to aft horizontal and transverse. The center of pressure pattern represents the orientation, magnitude and position of where the ground reaction force enters the body. It also provides a sense of how the center of mass of the body is transferred from heel contact to toeoff during gait.

The black solid line at the base shows the center of pressure path during normal running foot contact. It will be noted that after heel strike, the center of pressure path moves inwardly as the leg internally rotates and the foot pronates. From midstance until toeoff, the center of pressure path moves outwardly as the leg externally rotates and the foot resupinates. The vectors provide information concerning the magnitude and orientation of the center of pressure. The spacing in the particular graphs shown is designated at 15 millisecond intervals. Thus, when the space is greater between any two vectors, this is an indication that the center of mass of the body is being moved forwardly at a faster rate. Examination of the vector spacing reveals that more time is spent on the forefoot during the toeoff phase of running gait as compared to heel strike. The general profile of the center of pressure is similar to the vertical ground reaction force plot. This is because running, or gait in general, is basically a linear movement activity and the primary resistance is gravity.

Closer inspection of the center of pressure patterns of the propulsion plate combination design (FIG. 9) shows greater, more even spacing of the vectors than from the neutral midsole model (FIG. 8). This indicates that the center of mass is being propelled forwardly more efficiently. The differences between these factors on FIGS. 8 and 9 may be difficult for the untrained observer to ascertain, but are clearly visible to the trained observer in the art. Also, the straighter center of pressure path indicates more efficient mechanics of the foot and leg, i.e., pronation and supination. In the two diagrams, the most meaningful areas constitute the forward propulsion vectors beginning just forwardly of the highest vector. Specifically, in the 15 millisecond interval diagrams shown, there are 14 vectors depicted. The most important of these comprise, counting from the front end rearwardly, are numbers 4, 5 and 6. Comparing these 4, 5 and 6 vectors on the two diagrams shows that with the standard shoe, the foot, particularly the metatarsal heads, tend to sink into the viscoelastic polymer comprising the midsole to a greater extent so as to require considerably more muscular effort to propel the runner forwardly. In contrast, these vectors in the new shoe are spaced farther apart, showing forward propulsion occurring more rapidly because of energy return due to the unique construction. During the midstance of the gait, when the foot is pronating, the curvilinear arch of the spring plate externally of the shoe is able to flex downwardly under the force of the foot, and then return as the foot supinates. This, combined with the energy return as the force is transferred onto the metatarsal heads and subsequent toeoff, operates synchronously and synergistically with the natural spring action of the foot arch itself to achieve greater energy return.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention and should not be construed to limit the scope thereof.

The embodiments of the invention in which an exclusive property or privilege is claimed are defined as follows.

1. An athletic shoe comprising an upper, and a sole assembly attached to said upper;

said sole assembly comprising an outsole, a midsole and a spring plate therebetween, said sole assembly having a heel region, an arch region and a forefoot region which includes a metatarsal head region and a toe region;

said spring plate extending from beneath the medial portion of the heel region of said shoe, through the arch region of said shoe to and beneath the metatarsal head region and toe region of said shoe;

said spring plate being tapered to extend basically beneath the medial portion of said heel region;

said spring plate having a greater thickness and stiffness rearwardly from about the metatarsal head region of said shoe and substantially less thickness and stiffness forwardly of said metatarsal head region, joined in an integral interface juncture;

said integral interface juncture being at an acute angle relative to the center longitudinal axis of said shoe, sloping rearwardly toward the lateral side of said shoe;

said spring plate comprising bonded polymeric layers having elongated fibers arranged at an acute angle relative to the longitudinal center axis of said shoe, and oriented in composite symmetry relative to the center longitudinal axis; and said spring plate being of anisotropic stiffness, with a greater stiffness longitudinally than laterally.

2. The athletic shoe in claim 1 wherein said greater thickness is about twice that of said substantially less thickness.

3. An athletic shoe comprising an upper, and a sole assembly attached to said upper;

said sole assembly comprising an outsole, a midsole and a spring plate therebetween;

said spring plate comprising a single integral member extending from beneath the medial portion of the heel region of said shoe, through the arch region of said shoe to and beneath the metatarsal head region and the toe region of said shoe, said spring plate at said heel region being substantially more narrow than said midsole and extending primarily beneath the medial portion of the heel region, said spring plate sloping away from beneath the lateral portion of said heel region to leave the lateral portion of said outsole in said heel region in engagement with the lateral portion of said midsole in said heel region;

said spring plate having an upwardly convexly configurated arch at said arch region, being compressible downwardly under force; and said outsole having a medial opening beneath said spring plate arch to cause said spring plate arch to be on the exterior of said sole assembly.

4. The athletic shoe in claim 3 wherein said spring plate has a greater thickness rearwardly from the metatarsal head region of said shoe and less thickness forwardly of said metatarsal head region, joined in an integral interface.

5. An athletic shoe comprising an upper, and a sole assembly attached to said upper;

said sole assembly comprising an outsole, a midsole and a spring plate therebetween;

said spring plate comprising a single integral member extending from beneath the medial portion of the heel region of said shoe, through the arch region of said shoe to and beneath the metatarsal head region and the toe region of said shoe, said spring plate at said heel region being substantially more narrow than said midsole;

said spring plate having an upwardly convexly configurated arch at said arch region, being compressible downwardly under force;

said outsole having a medial opening beneath said spring plate arch to cause said spring plate arch to be on the exterior of said sole assembly;

said spring plate having a greater thickness rearwardly from the metatarsal head region of said shoe and less thickness forwardly of said metatarsal head region, joined in an integral interface;

said integral interface being at an acute angle relative to the center longitudinal axis of said shoe, sloping rearwardly to the lateral side thereof.

6. The athletic shoe in claim 5 wherein said acute angle is about 60° plus or minus about 10°.

7. The athletic shoe in claim 5 wherein said spring plate has parallel elongated fibers arranged at an acute angle relative to the longitudinal center axis of said shoe, and oriented in composite symmetry relative to the center longitudinal axis;

said spring plate being of anisotropic stiffness, with a greater stiffness longitudinally than laterally.

8. The athletic shoe in claim 7 wherein said greater thickness is composed of four layers and said lesser thickness is composed of two layers.

9. An athletic shoe comprising an upper, and a sole assembly attached to said upper;

said sole assembly comprising an outsole, a midsole and a spring plate therebetween, said sole assembly having a heel region, an arch region and a forefoot region which includes a metatarsal head region and a toe region;

said spring plate extending from beneath the medial portion of the heel region of said shoe, through the arch region of said shoe to and beneath the metatarsal head region and toe region of said shoe;

said spring plate being tapered down in said heel region to extend primarily beneath the medial portion of said heel region and not significantly beneath the lateral portion of said heel region, leaving the lateral portion of said outsole in said heel region in engagement with the lateral portion of said midsole in said heel region.

10. The shoe in claim 9 wherein:

said spring plate has a greater thickness rearwardly from about the metatarsal head region of said shoe and substantially less thickness forwardly of said metatarsal head region, joined in an integral interface juncture.

* * * * *